US010702007B2

(12) United States Patent
Reuben

(10) Patent No.: US 10,702,007 B2
(45) Date of Patent: Jul. 7, 2020

(54) VENTILATED ARTICLE OF FOOTWEAR

(71) Applicant: Ronie Reuben, Town of Mount Royal (CA)

(72) Inventor: Ronie Reuben, Town of Mount Royal (CA)

( * ) Notice: Subject to any disclaimer, the term of this patent is extended or adjusted under 35 U.S.C. 154(b) by 68 days.

(21) Appl. No.: 15/932,727

(22) Filed: Apr. 16, 2018

(65) Prior Publication Data

US 2019/0313730 A1 Oct. 17, 2019

(51) Int. Cl.

| | |
|---|---|
| ***A43B 7/06*** | (2006.01) |
| ***A43B 7/08*** | (2006.01) |
| ***A43B 5/00*** | (2006.01) |
| ***A43B 23/02*** | (2006.01) |
| ***A43B 23/08*** | (2006.01) |
| ***A43B 3/24*** | (2006.01) |

(52) U.S. Cl.

CPC ..... *A43B 7/084* (2013.01); *A43B 3/244* (2013.01); *A43B 5/002* (2013.01); *A43B 7/06* (2013.01); *A43B 23/027* (2013.01); *A43B 23/08* (2013.01)

(58) Field of Classification Search

CPC ..... A43B 23/08; A43B 3/24; A43B 3/242; A43B 3/244; A43B 7/06; A43B 7/005; A43B 23/027; A43B 7/084

USPC ..... 36/3 R, 3 A, 100, 101, 77 R

See application file for complete search history.

(56) References Cited

U.S. PATENT DOCUMENTS

| | | | | | |
|---|---|---|---|---|---|
| 3,175,311 | A * | 3/1965 | MacQuaid | A43C 13/14 | 36/72 R |
| 4,333,248 | A * | 6/1982 | Samuels | A43B 3/18 | 36/101 |
| 5,551,172 | A * | 9/1996 | Yu | A43B 7/10 | 36/3 A |
| 5,926,978 | A * | 7/1999 | Smith | A43B 3/24 | 36/101 |
| 7,340,852 | B1 * | 3/2008 | Tai | A43B 1/0018 | 36/100 |
| 10,104,932 | B2 * | 10/2018 | Kim | A43B 7/085 | |
| 2005/0016019 | A1 * | 1/2005 | Smith | A43B 3/103 | 36/11.5 |
| 2006/0230637 | A1 * | 10/2006 | Kipnes | A43B 3/24 | 36/94 |
| 2007/0017126 | A1 * | 1/2007 | Kipnes | A43B 3/24 | 36/101 |
| 2007/0130802 | A1 * | 6/2007 | Condie | A43B 1/0054 | 36/101 |
| 2008/0155860 | A1 * | 7/2008 | Tai | A43B 1/0018 | 36/101 |
| 2009/0229145 | A1 * | 9/2009 | Ortner | A43B 3/24 | 36/100 |

(Continued)

*Primary Examiner* — Marie D Bays

(74) *Attorney, Agent, or Firm* — Guy J. Houle; Houle Patent Agency Inc.

(57) ABSTRACT

A ventilated article of footwear, a boot or a shoe, has a disconnectable footwear portion partly detachably connected to the outer contour portion of the sole of the article of footwear. One or more connectors are secured on the top surface of the sole outer contour portion adjacent the disconnectable footwear portion and actionable to disconnect and reconnect the disconnectable footwear portion to the sole outer contour portion to permit the entrance of air between the sole outer contour portion and a lower edge of the disconnectable footwear portion to ventilate at least a portion of a users foot.

7 Claims, 5 Drawing Sheets

(56) References Cited

U.S. PATENT DOCUMENTS

| | | | | |
|---|---|---|---|---|
| 2014/0053433 | A1* | 2/2014 | Delaney | A43B 3/242 36/101 |
| 2015/0040434 | A1* | 2/2015 | Perkins | A43B 1/0054 36/101 |
| 2016/0073727 | A1* | 3/2016 | Bier | A43B 1/04 36/3 R |

* cited by examiner

VENTILATED ARTICLE OF FOOTWEAR

TECHNICAL FIELD

The present invention relates to a ventilated article of footwear and more particularly wherein the ventilation is effected by a disconnectable footwear portion which is partly detachably connected to the outer contour portion of the sole of the article of footwear and reconnectable thereto.

BACKGROUND OF THE INVENTION

It is known to ventilate the foot or toe portion of a person while wearing a shoe or boot. Several patents have been granted for ventilated shoes and most of these relate to ventilation through the sole using pumps and conduits or through holes to release fresh air against a wearers foot. Such sole aeration systems comprise the construction of a hollow sole to form a cavity in which a pump and conduits are located and the pump being activated by the heel of the wearer person when walking or running. The pump has an air intake and a pump nozzle connected to distribution channels which pumps fresh air through the insole and against the wearer's foot. Examples of such are found constructions are found in U.S. Pat. Nos. 8,387,276 and 8,919,011 as well has US Patent Publication 2008/0229623. Other forms of ventilated shoes or boots are known wherein the upper of the shoe has perforations or breathable fabrics to admit fresh air or release air.

Disadvantages of such known designs is that they are expensive to fabricate and often malfunction due to their design with the system being formed inside the sole of the shoe. These systems are also constantly subjected to impact by walking and running and not to mention the weight of the wearer person acting on a small pump. Still further, the ventilated system is constantly in operation and during cold weather period it is not always desirable to ventilate the fee with cold airt. It would be desirable to construct a ventilated shoe or boot with a non-perforated upper and which is simple in construction and which can be easily actuated and de-actuated by the wearer person when he/she feel a need to ventilate its feet.

SUMMARY OF THE INVENTION

It is therefore a feature of the present invention to provide a ventilated article of footwear which substantially obviates the above known disadvantages of the prior art and which provides the desirable need.

Another feature of the present invention is to provide an article of footwear having disconnectable footwear portions secured by one or more connectors which are easily actuable to disconnect the diconnectable footwear portions to ventilate the foot or toes or heel of a wearer person and to reconnect same.

Another feature of the present invention is to provide an article of footwear having disconnectable footwear portions secured to the outer contour portion of the sole of the article of footwear and wherein the one or more connectors are secured to the exterior surface of the sole along the side edge of the shoe or boot upper and easily accessible to the wearer person.

According to the above features, from a broad aspect, the present invention provides a ventilated article of footwear having a disconnectable footwear portion partly detachably connected to the sole outer contour portion of the article of footwear. A connector is actionable to disconnect and reconnect the disconnectable footwear portion to the sole outer contour portion whereby to permit the entrance of air between the sole outer contour portion and a lower edge of the disconnectable footwear portion to ventilate at least a portion of a users foot.

DESCRIPTION OF THE DRAWINGS

A preferred embodiment of the present invention will now be described with reference to the accompanying drawings which illustrates examples thereof.

DESCRIPTION OF THE PREFERRED EMBODIMENT

Figure 1:
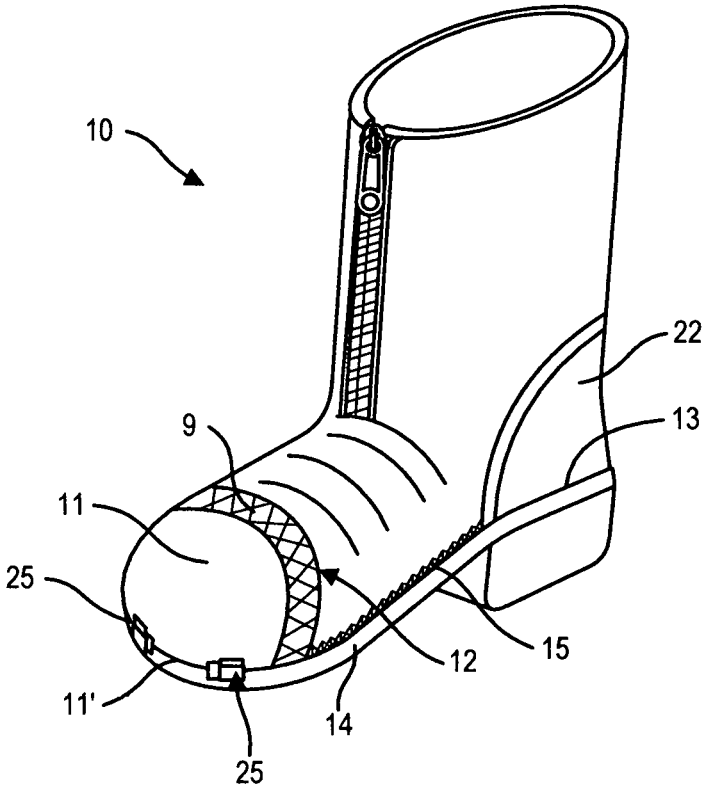
FIG. 1 is a perspective view of a boot provided with the ventilated system of the present invention wherein the front toe portion is a disconnectable portion herein shown in its connected state.
Figure 2:
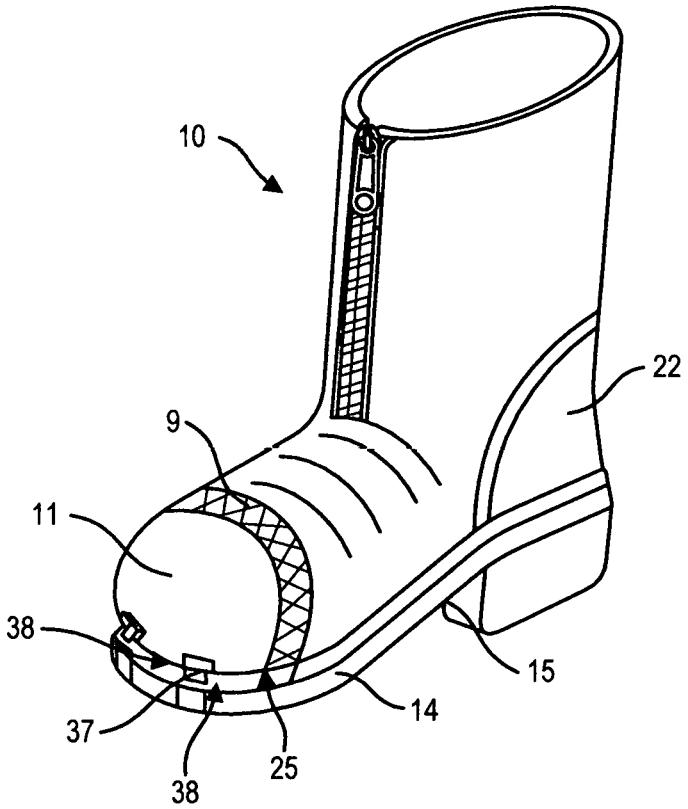
FIG. 2 is a perspective view similar to FIG. 1 but showing the disconnectable portion disconnected to permit air flow to the toes of the wearer person.
Figure 3:
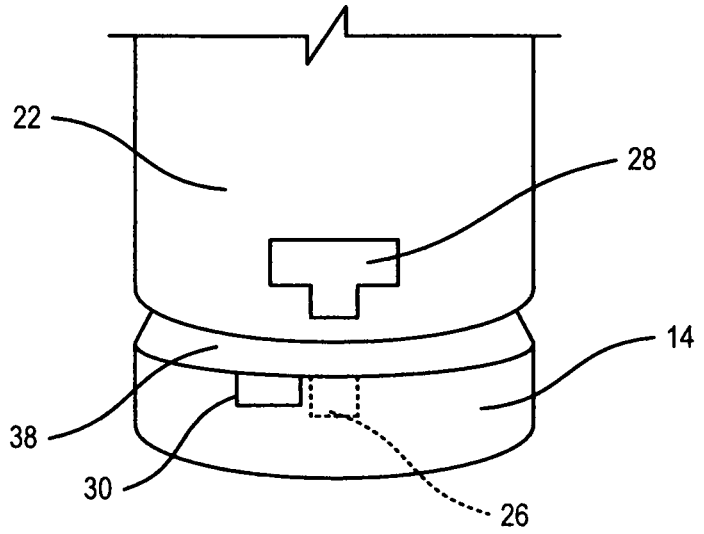
FIG. 3 is a rear view of the boot showing the rear heel section as a diconnectable portion with the connector disengaged to permit ventilation in the rear of the boot.
Figure 5A:
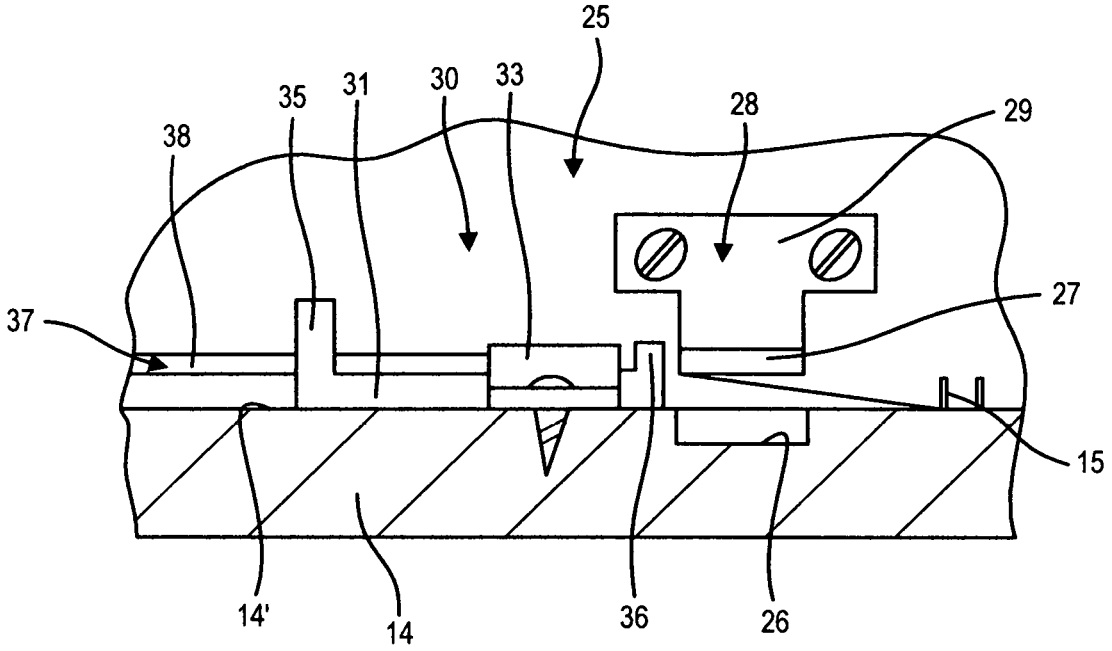
FIG. 5A is a fragmented side view of the slide lever connector at a disengaged position showing the front toe portion of the shoe disconnected to admit air flow inside the shoe to ventilate the toes of a wearer person.
Figure 5B:
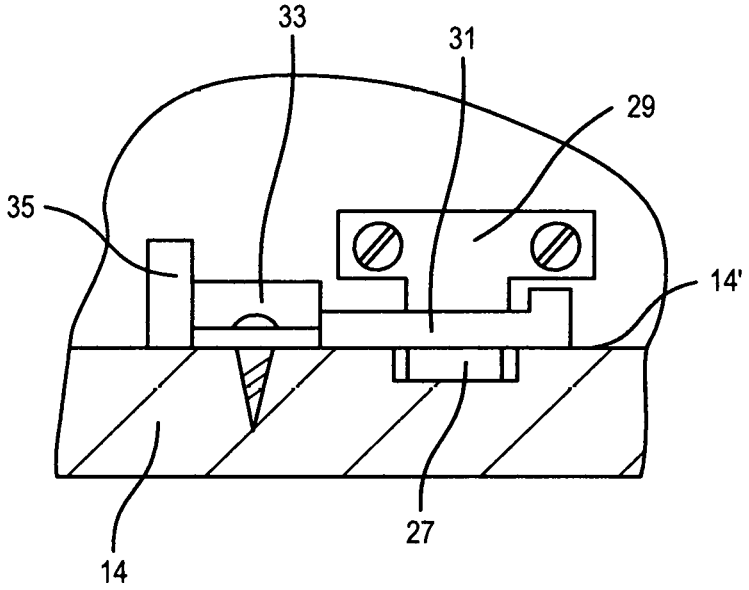
FIG. 5B is a fragmented side view similar to FIG. 5A showing the slide lever connector at an engaged position showing the front toe portion of the shoe at an engaged position.
Figure 6:
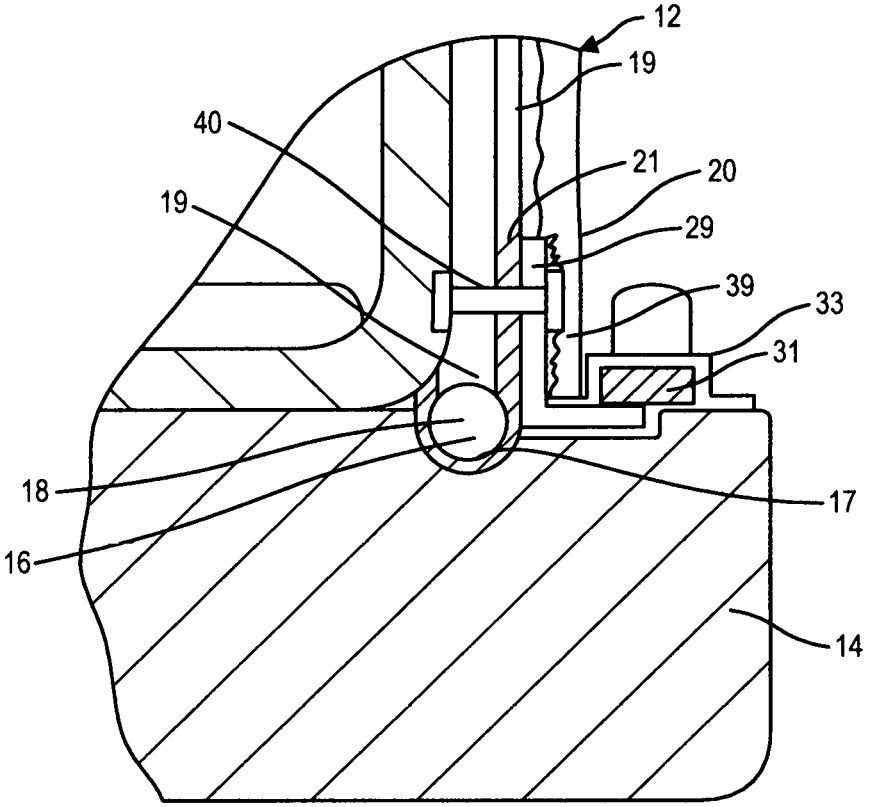
FIG. 6 is a fragmented, enlarged, section view illustrating the constructions of the slide lever connector parts secured to the upper surface of the sole outer contour portion and the shoe upper and the connection of the engageable bracket secured above the lower edge of the disconnectable footwear portion.

Referring now to the drawings, and more particularly to FIGS. 1 to 6, there is shown a boot 10, or it could be a shoe, embodying the present invention in that the front toe portion 11 of the boot or shoe is a disconnectable portion. The boot or shoe upper 12 is secured along its lower edge 13 to the outer contour portion 14' of the sole 14 by suitable securement means herein stitches 15. The front toe portion lower edge 11' is not secured by threads and is formed with a rigid shaped lower seal forming edge 16, see FIG. 6, adapted to be received in a channel 17 formed adjacent an inside edge of the top surface 14" of the outer contour portion 14' of the sole to form a seal when a locking connector(s) 20 is engaged. As shown in FIG. 6, the seal forming edge is formed by a rigid shaped wire or rigid trend 18 secured to a lower edge 19 of the shoe upper side wall 19 by a fabric connecting piece 20 attached by adhesive 21. The seal forming edge 16 may also be a molded part or other suitable type of sealing edge. As shown in FIG. 3, the disconnectable portion can also be the heel portion 22 of the boot or shoe. A flexible band 9 permits the toe portion 11 to hinge up slightly.

Figure 4:
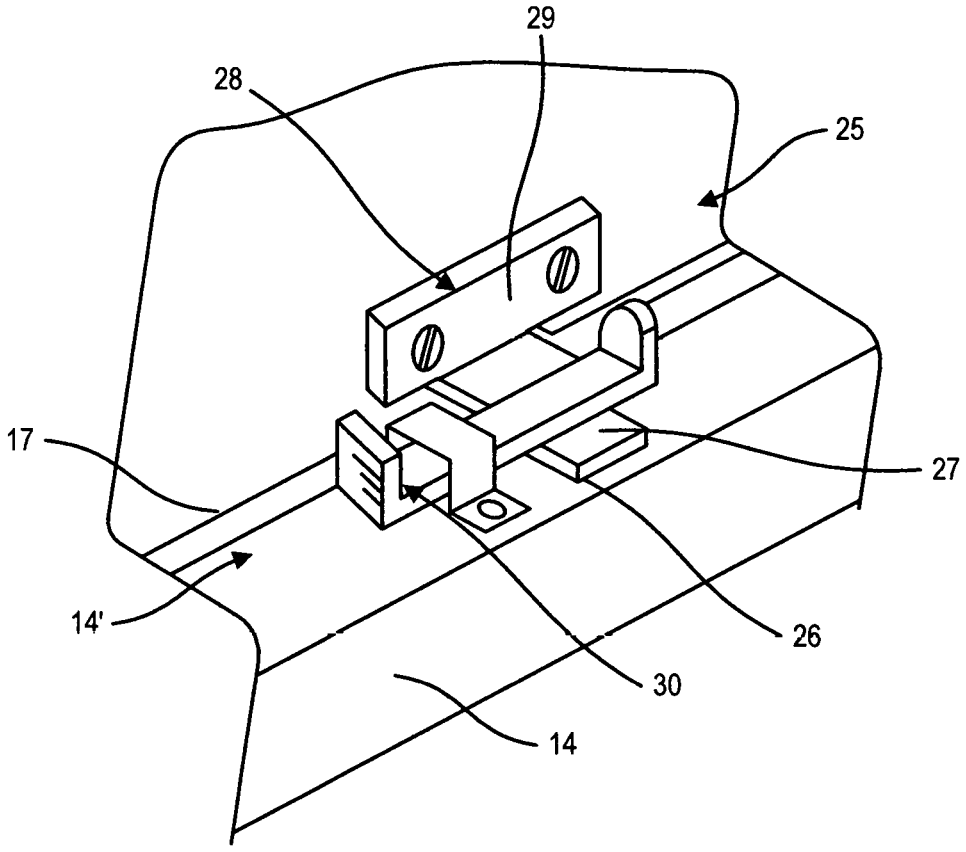
FIG. 4 is a fragmented perspective view showing the construction of an example of the slide lever connector.

With reference now to FIGS. 4 to 6, there will be described the construction of the connector 25 or sliding mechanism which connects the connectable shoe portion 11 or 22 to the top surface 14" of the outer contour portion 14' of the sole 14. As shown, a small rectangular or square cavity 26 is formed in the top surface 14" of the sole outer contour portion 14' and dimensioned for receiving in close fit therein an attachable part, herein a rectangular tongue projection 27 of an engageable bracket 28 secured above the lower edge 16 of the diconnectable footwear portion 11. The tongue projection is a flat metal part extending at an angle wherein to lay flat in the cavity 26. The engageable bracket 28 has an attachment flange 29 secured to the upper of the boot or shoe by suitable fastening means, such as rivets, screw fasteners, glue, sewing thread or other suitable fastening means as is well known to a person skilled in the art. The connector 25 also has a slide mechanism 30 for locking and unlocking the tongue projection 27 of the engageable bracket 28.

The slide mechanism 30 is comprised of a slide lever 31 having a slide bar portion 32 held captive under an inverted U-shaped bracket 33 secured by fasteners 34 to the top surface 14" of the outer contour portion 14' of the sole. One end of the slide bar as a finger engaging upturned portion 35 to be gripped between the fingers of a user person to impart sliding motion to the slide bar. The other end of the slide bar 32 also has an upturned portion to prevent disconnection of the slide mechanism by providing an abutment end 36 for abutment against the bracket 33 and clear of the slot 26 when the slide bar is retracted to release the tongue projection 27 of the bracket 28, as shown in FIG. 5A, wherein the toe portion 11 is partly detached from the sole outer contour portion to provide a separation gap 37 to permit air flow, as depicted by arrow 38 to ventilate the toes of the wearer person. FIG. 5B illustrates the connector 25 in an engaged position wherein the tongue projection 27 is held captive within the cavity 26 by the slide bar portion 32 of the slide mechanism 30. FIG. 3 illustrates the connector 25 in a disengaged position with the disconnectable heel portion 22 disconnected from the sole outer contour portion to permit the flow of air to the rear foot portion of the wearer person.

Figure 8:
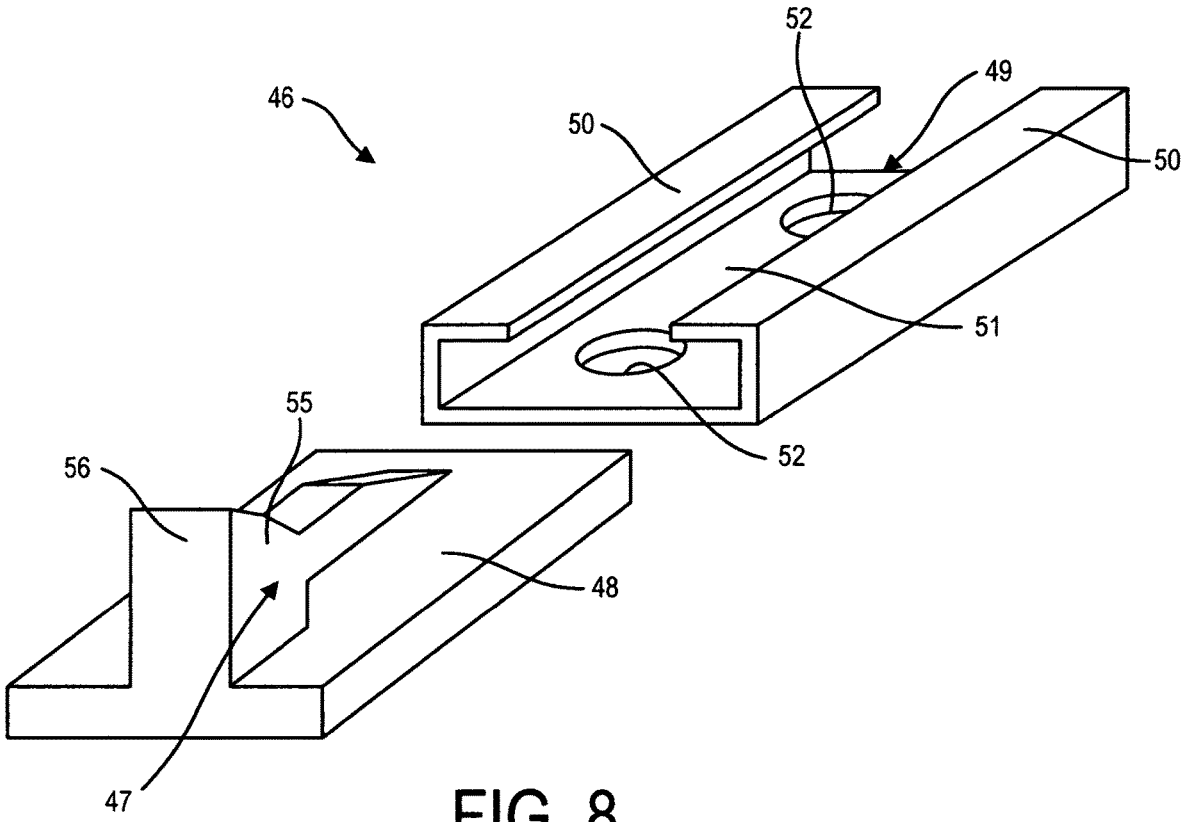
FIG. 8 is an exploded view illustrating the construction of the clamping jaw connector.
Figure 9:
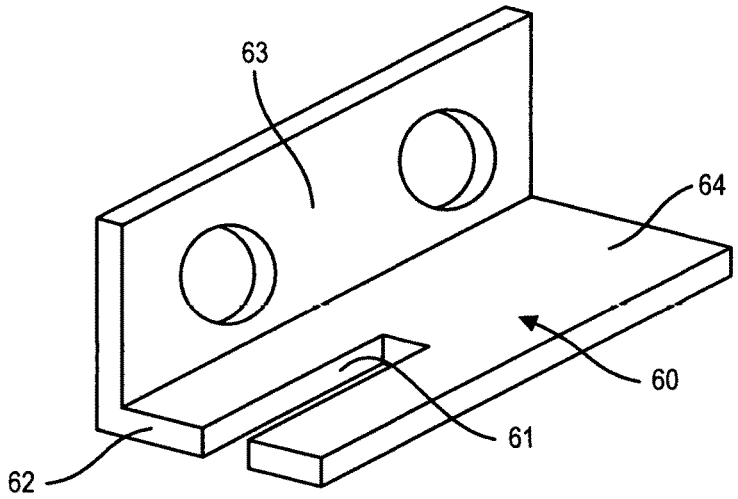
FIG. 9 is a perspective view of the engageable bracket.

With reference again to FIG. 6, the attachable flange 29 of the engageable bracket 28 is herein shown concealed by an outer fabric layer 39 glued over the flange 29. The flange 29 is connected to the lower end of the boot or shoe upper 12 by rivets 40. The engageable bracket 28 may also be secured on the outer surface of the boot or shoe upper by fasteners such as the rivets 40 and be concealed by a paint color or formed of a material composition resembling the surrounding color the material forming the upper of the boot or shoe With reference now to FIGS. 7 to 9, there will be described a further example of the slide locking mechanism herein denoted by reference numeral 30' and has herein shown the slide locking mechanism 30' is secured inside an elongated rectangular cavity 45 disposed in the top surface 14" of the outer contour portion 14' of the sole 14 and disposed longitudinally thereon. The engageable bracket 28' is formed like the bracket 28 described earlier with the exception that the tongue projection 27 is different. As herein shown, the tongue projection 60 of the engageable bracket 28' is a flat metal piece of rectangular shape which extends at an angle of about 90 degrees from its attachment flange 63 wherein to lay flat on the top surface 14" of the outer contour portion 14' of the sole 14 and is dimensioned to extend across the cavity 45. The the tongue projection 60 has a slot 61 extending from a leading side edge 62 thereof and terminates a predetermined distance from the leading side edge whereby to define a clamping surface 64 forwardly thereof for engagement by a displaceable slide locking mechanism 30'.

Figure 7:
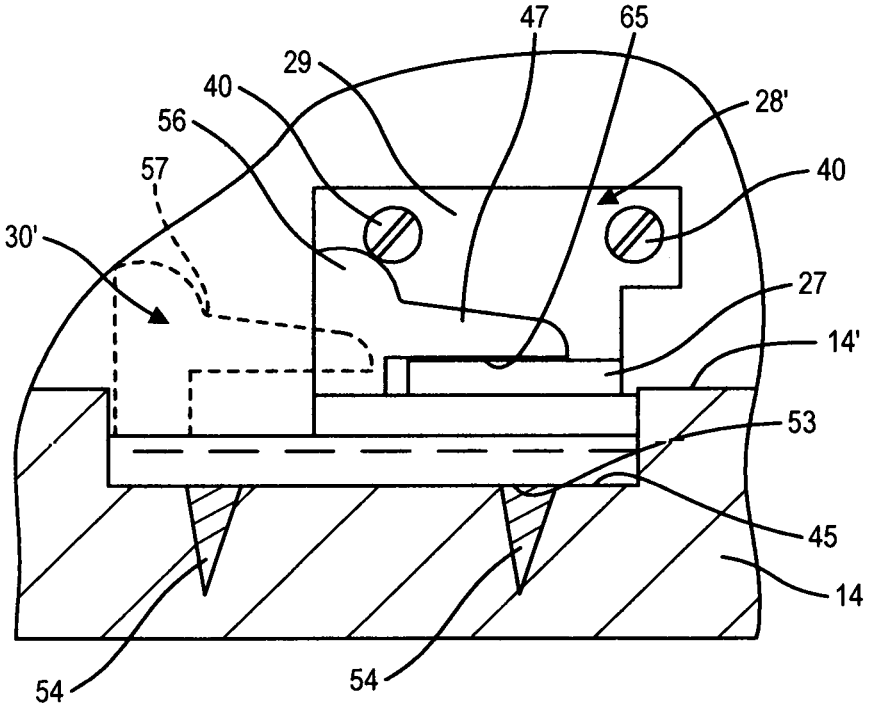
FIG. 7 is a fragmented side view showing the construction of another example of the connector wherein the locking mechanism has a slide member provided with a clamping jaw and illustrating the clamping jaw at a locked and unlocked position to engage and disengage the engageable bracket secured to the disconnectable portion of the boot or shoe.

The slide locking mechanism 30' is comprised of a slide member 46 formed with a clamping jaw 47 extending vertically upwards from its sliding support base 48. The sliding support base 48 is held in sliding fit in an attachment plate 49 having upturned opposed side edges 50 under which opposed side edges of the sliding support base 48 are held slidingly captive. The attachment plate 49 has a flat bottom wall 51 formed with holes 52 for securement thereof to the bottom wall 53 of the cavity 45 by fasteners 54 or other suitable means such as glue, etc. The clamping jaw 47 has a clamp head 55 held at an elevated position above the cavity 45 whereby a slightly inwardly slopped clamping edge 56 thereof is aligned with the top surface of the tongue projection 60 of the engageable bracket 28' to progressively engage the clamping surface 64 as it is moved thereover to clamp the tongue projection 60 firmly across the cavity 53 and secure the seal forming edge 16 of the diconnectable footwear portion in the channel 17 of the sole 14. The clamping jaw 47 has a finger engaging projection 56 for ease of displacement of the clamping jaw 47 to its engaged position, as shown in FIG. 7, to its disengaged position as shown by phantom lines 57. The finger engaging projection 56 may have several shapes to accommodate the fingers of a user person.

It within the ambit of the present invention to cover any obvious modifications of the examples described herein provided such modifications fall within the scope of the appended claims. It is foreseen, for example, that the article of footwear may be an entirely molded article of footwear modified to incorporate the connecting mechanisms described herein. Also, the disconnectable parts of the article of footwear may be formed as molded parts with a bottom edge seal formation. The article of footwear may be of different types such as athletic shoes, hiking boots, and many other types where foot ventilation is desirable. Other modifications of the connectors described herein are also contemplatable.

The invention claimed is:

1. A ventilated article of footwear, said article of footwear having a disconnectable footwear portion partly detachably connected to a sole outer contour portion of said article of footwear, and a connector actionable to disconnect and reconnect said disconnectable footwear portion to said sole outer contour portion to permit the entrance of air between said sole outer contour portion and a lower edge of said disconnectable footwear portion to ventilate at least a portion of a users foot, and wherein said connector comprises an anchor cavity formed in said sole outer contour portion, an engagable bracket secured above said lower edge of said disconnectable footwear portion and having a flat metal tongue, the flat metal tongue received in the anchor cavity, a slide mechanism which slides between a retracted position to release the tongue to raise out of the cavity to provide a separation gap between the sole outer contour portion and the disconnectable footwear portion to allow ventilation and a locked orientation locking the tongue in the cavity which prevents ventilation.

2. The ventilated article of footwear as claimed in claim 1 wherein said lower edge of said disconnectable footwear portion is a rigid shaped lower seal forming edge adapted to be recieved in a channel formed adjacent an inside edge of a top surface of said sole outer contour portion to form a seal when said connector connects said attachable part of said disconnectable footwear portion to said sole, said sole outer contour portion being an upper contour upper face of said sole.

3. The ventilated article of footwear as claimed in claim 1 wherein said engageable bracket has an attachment flange for securement to said disconnectable footwear portion by fastening means.

4. The ventilated article of footwear as claimed in claim 3 wherein said fastening means is one of rivets, screw fasteners, glue and sewing thread.

5. The ventilated article of footwear as claimed in claim 1 wherein said engageable bracket is concealed by material forming part of said article of footwear, said bracket is colored to substantially match a color of the area of said disconnectable footwear portion.

6. The ventilated article of footwear as claimed in claim 1 wherein said disconnectable footwear portion is one of a front toe cap portion and a rear heel portion.

7. The ventilated article of footwear as claimed in claim 6 wherein said front toe cap portion or said rear heel portion is a rigid molded portion.

* * * * *